US007880401B2

(12) United States Patent
Kitagawa et al.

(10) Patent No.: US 7,880,401 B2
(45) Date of Patent: Feb. 1, 2011

(54) LIGHTING CONTROLLING DEVICE OF VEHICLE LIGHTING EQUIPMENT

(75) Inventors: Takayoshi Kitagawa, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 366 days.

(21) Appl. No.: 12/182,615

(22) Filed: Jul. 30, 2008

(65) Prior Publication Data

US 2009/0072764 A1 Mar. 19, 2009

(30) Foreign Application Priority Data

Aug. 1, 2007 (JP) ..... 2007-200657

(51) Int. Cl.
*H05B 41/16* (2006.01)

(52) U.S. Cl. ..... 315/247; 315/291; 315/185 S; 315/224; 315/312

(58) Field of Classification Search ..... 315/247, 315/246, 224, 225, 209 R, 185 S, 291, 297, 315/307–326, 274–279
See application file for complete search history.

(56) References Cited

U.S. PATENT DOCUMENTS

2002/0130628 A1* 9/2002 Shin ..... 315/312
2007/0069664 A1* 3/2007 Robinson et al. ..... 315/312
2008/0088571 A1* 4/2008 Lee et al. ..... 345/102
2009/0021384 A1* 1/2009 Jacubovski et al. ..... 340/653
2009/0066262 A1* 3/2009 Tateishi et al. ..... 315/291
2009/0080174 A1* 3/2009 Shimotomai et al. ..... 362/1

FOREIGN PATENT DOCUMENTS

JP 2006-103477 A 4/2006

* cited by examiner

*Primary Examiner*—Tuyet Thi Vo
(74) *Attorney, Agent, or Firm*—Osha • Liang LLP

(57) ABSTRACT

A lighting controlling device of vehicle lighting equipment includes switching regulators for supplying a current to a plurality of semiconductor light sources respectively; a plurality of current driving portions, having switching elements connected to the semiconductor light sources for controlling ON/OFF of the semiconductor light sources, for current-driving the semiconductor light sources at a maximum current value or a current value smaller than the maximum current value in response to respective operating states of the switching elements; current setting portion for setting a maximum current value applied in current-driving the current driving portion or a maximum current value of currents fed from the switching regulators to the semiconductor light sources separately in plural stages in response to respective assignments; and a controlling portion for controlling the current driving portion and the current setting portion in response to a plurality of lighting modes based on communication information from an external device. The controlling portion assigns the maximum current value corresponding to each lighting mode to the current setting portion for every lighting mode, and assigns ON/OFF periods of the switching elements to the current driving portion for every lighting mode.

6 Claims, 5 Drawing Sheets

FIG. 2(a)

| | SWITCHING REGULATOR 14 | | | | SWITCHING REGULATOR 16 | | | |
|---|---|---|---|---|---|---|---|---|
| LED | 1 | 2 | 3 | 4 | 5 | 6 | 7 | 8 |
| MODE1 | 0, 8A | 0, 8A | 1A | 1A | 0, 8A | 1A | 0A | 0A |
| MODE2 | 1A | 1A | 0, 8A | 0A | 0A | 0A | 1A | 1A |
| MODE3 | 1, 6A | 0A | 0A | 1A | 1, 3A | 1A | 1A | 0A |

FIG. 2(b)

| | SWITCHING REGULATOR 14 | | | | SWITCHING REGULATOR 16 | | | |
|---|---|---|---|---|---|---|---|---|
| LED | 1 | 2 | 3 | 4 | 5 | 6 | 7 | 8 |
| MODE1 | 80% | 80% | 100% | 100% | 80% | 100% | 0% | 0% |
| MODE2 | 100% | 100% | 80% | 0% | 0% | 0% | 100% | 100% |
| MODE3 | 100% | 0% | 0% | 62.5% | 100% | 76.9% | 76.9% | 0% |

FIG. 2(c)

| TIMER | A | B | C |
|---|---|---|---|
| MODE1 | 80% | 100% | 100% |
| MODE2 | 100% | 100% | 80% |
| MODE3 | 100% | 76.9% | 62.5% |

LIGHTING CONTROLLING DEVICE OF VEHICLE LIGHTING EQUIPMENT

BACKGROUND OF INVENTION

1. Field of the Invention

The present invention relates to a lighting controlling device of vehicle lighting equipment and, more particularly, a lighting controlling device of vehicle lighting equipment constructed to control lighting of semiconductor light sources constructed by semiconductor for light remitting elements.

2. Background Art

Conventionally, lighting equipment using semiconductor light emitting elements such as LEDs (Light Emitting Diodes) as the light sources has been known as vehicle lighting equipment. A lighting controlling device for controlling the lighting of LEDs is included in the vehicle lighting equipment of this type.

As the lighting controlling device, a device equipped with a current driving portion connected in series with LEDs to control LEDs such that a normal current flows though LEDs, and a switching regulator for controlling an output voltage applied to LEDs at a maximum voltage in response to a controlled state of the current driving portion has been known. The switching regulator can control the output voltage such that a normal current flows though LEDs respectively even when a plurality of LEDs are connected in series or parallel with the switching regulator.

However, when the output of the switching regulator is short-circuited or grounded, a load of the switching regulator becomes heavy, and occasionally failure is caused due to application of an excessive power. Also, when the output of the switching regulator is opened by a disconnection, or the like, sometimes the output voltage rises excessively in the fly-back switching regulator, for example.

Therefore, such a switching regulator has been proposed that the current driving portion controls the semiconductor light sources (LEDs) such that a normal current flows though LEDs and also the switching regulator controls the output voltage applied to the semiconductor light sources (LEDs) at the maximum voltage in response to the controlled state of the current driving portion, and an operation of the switching regulator is stopped when the output voltage is lowered abnormally on account of a ground fault of the anode side of any semiconductor light source (LED) or a short-circuit of the output side of the switching regulator (see Patent Literature 1).

[Patent Literature 1] JP-A-2006-103477 (particularly, p. 4 to p. 6, FIG. 1)

SUMMARY OF INVENTION

In the above prior art, when failure is caused on the output side of the switching regulator, an operation of the switching regulator is stopped by detecting such failure, so that LEDs are protected. However, no consideration is given to situations in which respective semiconductor light sources (LEDs) are turned ON/OFF individually.

When four types of light sources, e.g., high-beam headlamp, turn signal lamp, cornering lamp, and DRL (Daytime Running Lamp), are needed as the light source of the vehicle lighting equipment the control circuit (e.g., microcomputer) for controlling respective current driving portions individually in compliance with communication information (information used to turn ON/OFF respective semiconductor light sources) from the outside is needed as the lighting control device, in addition to the switching regulator and four current driving portions.

In contrast, when the control circuit for controlling respective current driving portions individually in compliance with communication information from the outside is provided and then respective current driving portions are controlled in compliance with the control signal generated by the control circuit to turn ON/OFF individually, respective LEDs can be turned ON/OFF LEDs individually by outputting a high-level or low-level signal to respective current driving portions as a control signal.

However, when DC currents supplied to respective LEDs are reduced simply directly as a DC current to dim respective LEDs individually, colors of LEDs are changed and occasionally a color shift occurs. Also, when a DC current supplied to a particular LED out of a plurality of LEDs is reduced directly as a DC current a forward voltage Vf of the concerned LED is decreased because of the V-I characteristic, and in some cases a loss is produced in the switching element (NMOS transistor) that drives this LED.

Therefore, when respective LEDs are dimmed individually, the PWM (Pulse Width Modulation) signal (ON/OFF signal) whose duty ratio is changed in response to a dimmed level is generated, and ON/OFF of the signal are repeated alternately. Therefore, such a control can be applied that a current flowing through LEDs in a predetermined period, i.e., a so-called average current is reduced. As a result, occurrence of a color shift in a dimmed lighting of LEDs can be suppressed and a loss in the switching element can be reduced.

However, when the PWM signal is frequently used as the control signal to turn ON/OFF or dim respective LEDs individually, either a precision of currents of respective is worsened or a discrepancy between an ideal current value and the actual current value occurs depending on a duty ratio and, thus, a linearity cannot be maintained.

One or more embodiments of the present invention suppress a color shift and an increase of loss and also maintain a linearity based on a precision of current and a duty ratio of respective semiconductor light sources when ON/OFF and dimmed operations of a plurality of semiconductor light sources are controlled individually.

A lighting controlling device of a vehicle lighting equipment according to one or more embodiments includes switching regulators for supplying a current to a plurality of semiconductor light sources respectively; a plurality of current driving means, having switching means connected to the semiconductor light sources for controlling ON/OFF of the semiconductor light sources, for current-driving the semiconductor light sources at a maximum current value or a current value smaller than the maximum current value in response to respective operating states of the switching means; current setting means for setting a maximum current value applied in current-driving the current driving means or a maximum current value of currents fed from the switching regulators to the semiconductor light sources separately in plural stages in response to assignment respectively; and a controlling portion for controlling the current driving means and the current setting means in response to a plurality of lighting modes based on communication information from an external device; wherein the controlling portion assigns the maximum current value corresponding to each lighting mode to the current setting means every lighting mode, and assigns ON/OFF periods of the switching means to the current driving means every lighting mode.

In controlling the ON/OFF operation and the dimmed operation of a plurality of semiconductor light sources individually in response to a plurality of lighting modes based on the communication information from the external device, the controlling portion assigns the maximum current values corresponding to respective lighting modes to the current setting means based on the communication information in respective lighting modes, and assigns the ON/OFF periods of the switching means to the current driving means in respective lighting modes. The current driving means, to which the ON period (during which the ON operation of the switching means is continued) is assigned, out of a plurality of current driving means drive the semiconductor light sources at the maximum current value set by the current setting means. As a result, the semiconductor light sources are turned ON at the large current value.

In contrast, the current driving means, to which the ON/OFF period (during which the ON operation or the OFF operation of the switching means is repeated) is assigned, ON/OFF-drive the semiconductor light sources based on the maximum current value set by the current setting means. Consequently, the semiconductor light sources are driven by the current value that is smaller than the maximum current value set by the current setting means. As a result, the semiconductor light sources are turned ON in a dimmed state (dimmed) at the current value that is smaller than the maximum current value.

In this manner, when ON/OFF and dimmed operations of a plurality of semiconductor light sources are controlled individually, the semiconductor light sources as the turned-ON objects are driven at the maximum current value, and the semiconductor light sources as the dimmed objects are ON/OFF-driven at the current value smaller than the maximum current value, so that a linearity based on a precision of current and a duty ratio of respective semiconductor light sources can be maintained. As a result, a loss in respective switching means can be reduced and also it can be suppressed that a precision of the currents of respective semiconductor light sources is lowered.

In the lighting controlling device of the vehicle lighting equipment according to one or more embodiments, in the lighting controlling device of the vehicle lighting equipment set forth above, the plurality of current driving means are classified into plural groups such that the current driving means used commonly in the plurality of lighting modes in all are classified into same groups, the current driving means in respective groups are connected electrically mutually, and the controlling portion assigns the ON/OFF periods of the switching means to the current driving means, which are connected to the semiconductor light sources acting as turned-ON and dimmed objects, out of the current driving means in respective groups under same driving conditions every group, and also assigns an OFF drive to the current driving means that are connected to the semiconductor light sources acting as turned-OFF objects, based on elements different from elements that are used to assign the ON/OFF period.

A plurality of current driving means are classified into plural groups, the current driving means in respective groups are connected electrically mutually. Also, the ON/OFF periods of the switching means are assigned to the current driving means, which are connected to the semiconductor light sources as the turned-ON and dimmed objects, out of the current driving means in respective groups under the same driving conditions every group, and also the OFF drive is assigned to the current driving means that are connected to the semiconductor light sources as the turned-OFF objects, based on the elements different from the elements that are used to assign the ON/OFF period. As a result, the number of elements that are used to assign the ON/OFF periods of the switching means, e.g., the number of timers, can be set equal to the number of groups, and can be reduced smaller than the number of the current driving means.

As apparent from the above explanation, according to the lighting control device for the vehicle lighting equipment according to one or more embodiments, a loss in respective switching means can be reduced and also it can be suppressed that a precision of the currents of respective semiconductor light sources is lowered.

According to one or more embodiments, the number of elements that are used to assign ON/OFF periods of the switching means can be reduced.

Other aspects and advantages of the invention will be apparent from the following description, the drawings and the claims.

BRIEF DESCRIPTION OF DRAWINGS

FIG. 2(*a*) is a table explaining relationships between various lighting modes and currents of respective LEDs, FIG. 2(*b*) is a table explaining relationships between various lighting modes and quantities of light of respective LEDs, and FIG. 2(*c*) is a table explaining relationships between various lighting modes and duty ratios of a control signal generated by respective timers.

DETAILED DESCRIPTION

Figure 1:
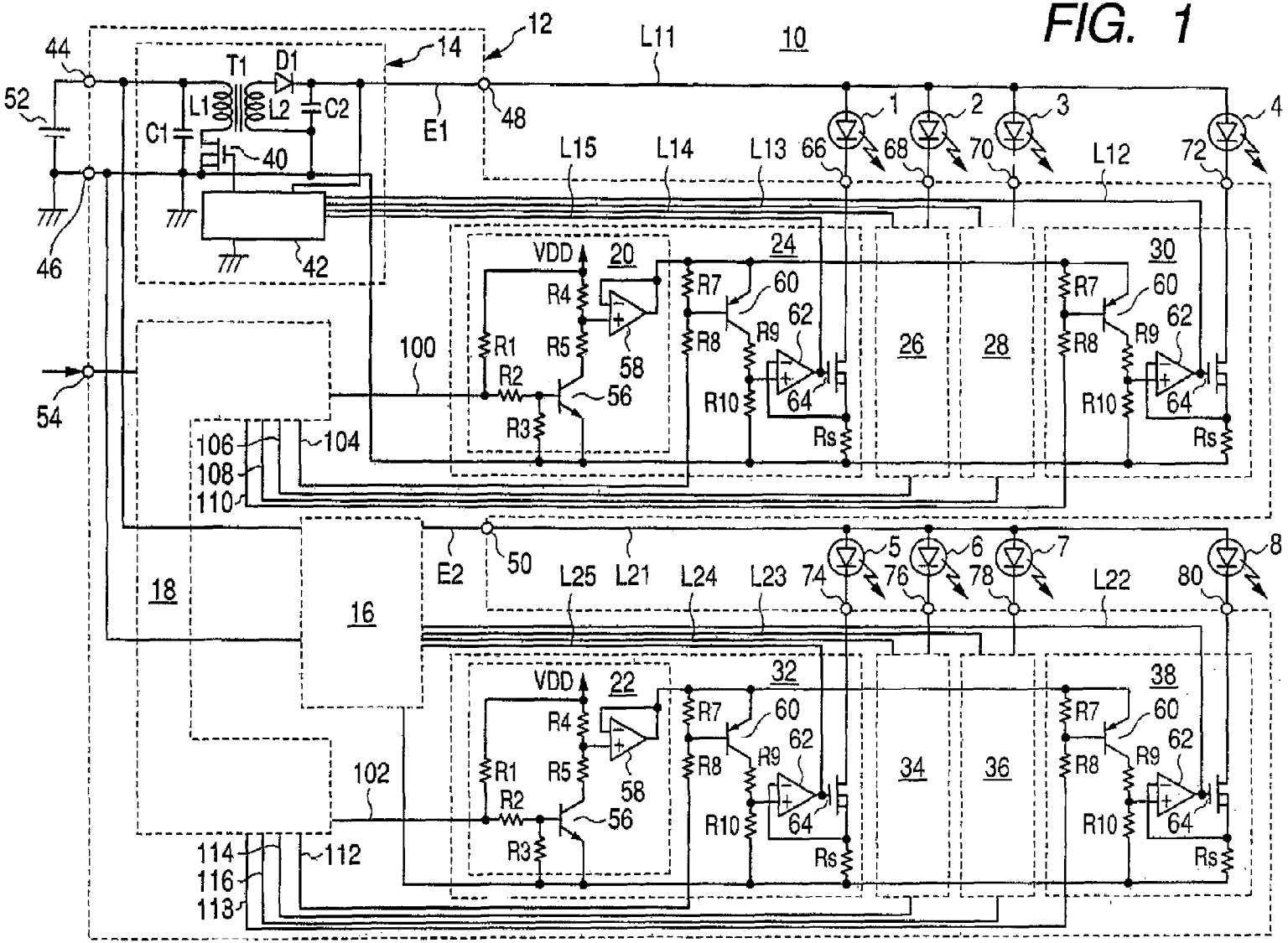
FIG. 1 is a block configurative diagram of a lighting control device for vehicle lighting equipment showing a first embodiment of the present invention.
Figure 3:
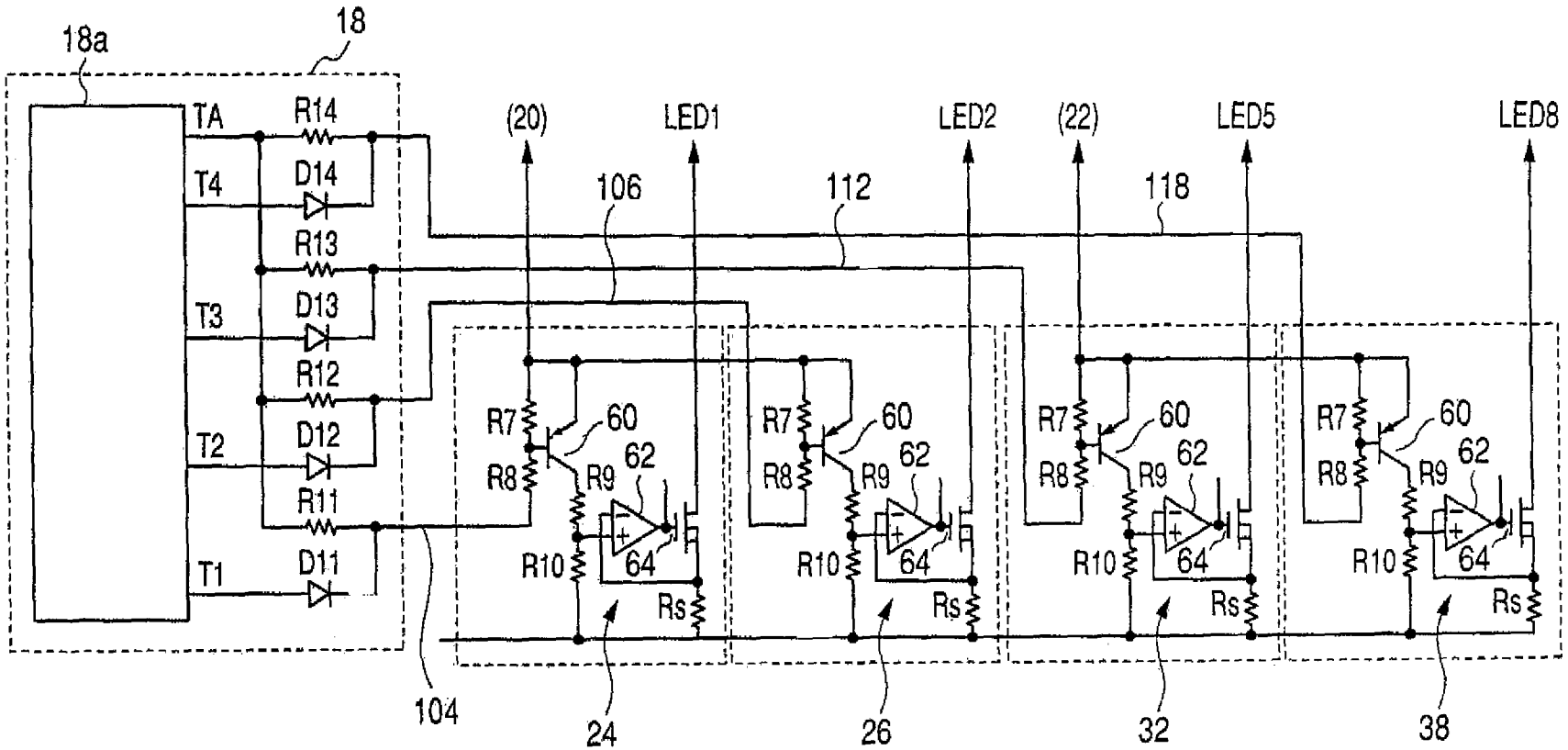
FIG. 3 is a pertinent block configurative diagram of a lighting control device for vehicle lighting equipment showing a second embodiment of the present invention.
Figure 4:
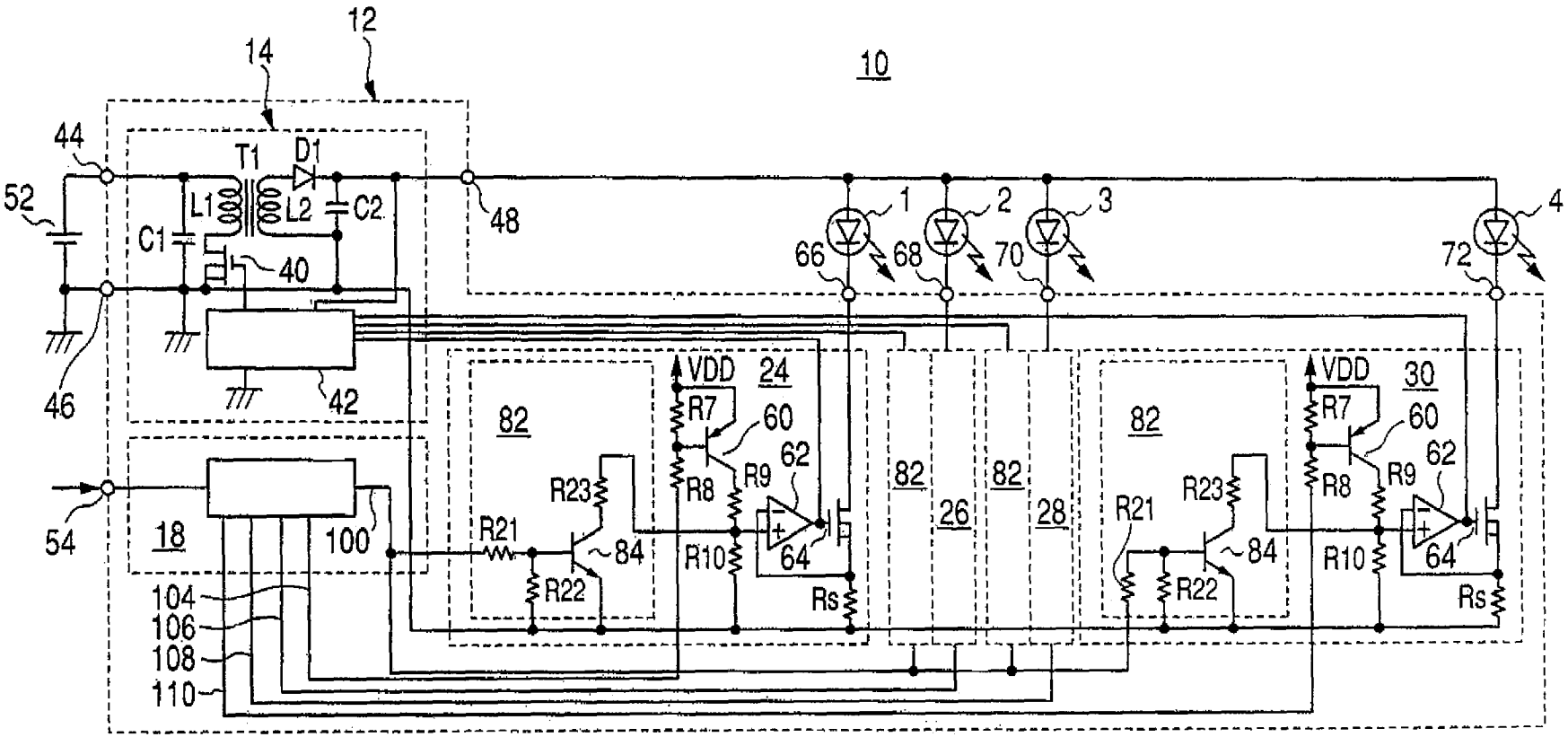
FIG. 4 is a pertinent block configurative diagram of a lighting control device for vehicle lighting equipment showing a third embodiment of the present invention.
Figure 5:
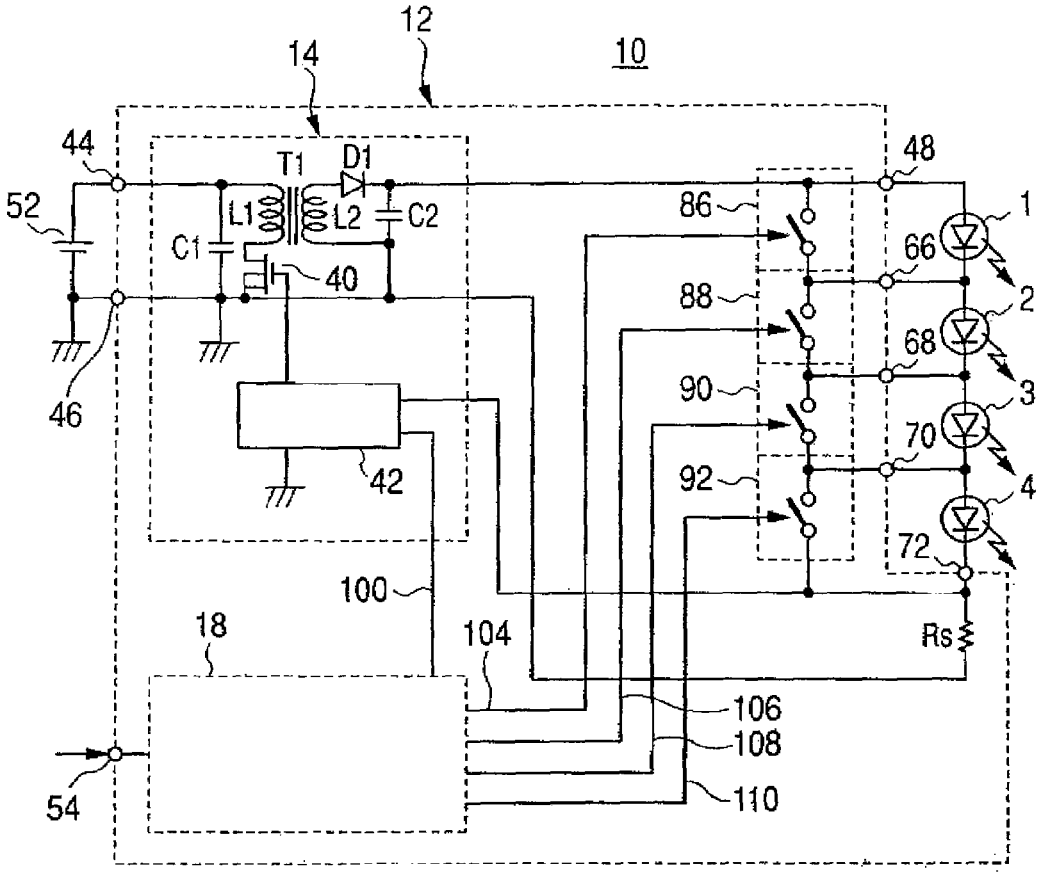
FIG. 5 is a pertinent block configurative diagram of a lighting control device for vehicle lighting equipment showing a fourth embodiment of the present invention.
Figure 6:
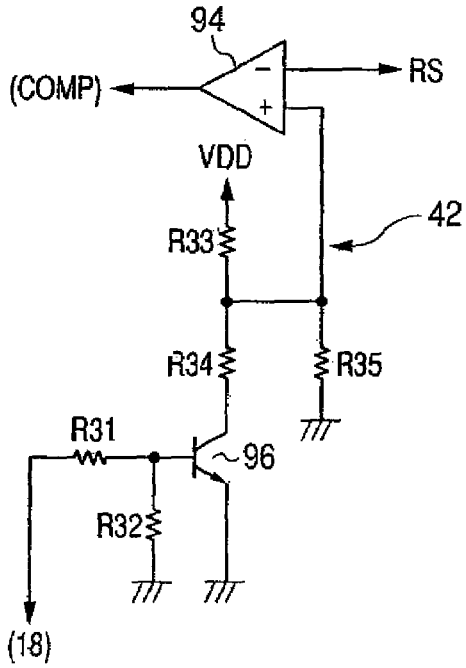
FIG. 6 is a pertinent circuit configurative diagram of a control circuit in the fourth embodiment of the present invention.

Embodiments of the present invention will be explained with reference to the drawings hereinafter. FIG. 1 is a block configurative diagram of a lighting control device for a vehicle lighting equipment showing a first embodiment of the present invention, FIG. 2(*a*) is a table explaining relationships between various lighting modes and currents of respective LEDs, FIG. 2(*b*) is a table explaining relationships between various lighting modes and quantities of light of respective LEDs, and FIG. 2(*c*) is a table explaining relationships between various lighting modes and duty ratios of a control signal generated by respective timers, FIG. 3 is a pertinent block configurative diagram of a lighting control device for a vehicle lighting equipment showing a second embodiment of the present invention, FIG. 4 is a pertinent block configurative diagram of a lighting control device for a vehicle lighting equipment showing a third embodiment of the present invention, FIG. 5 is a pertinent block configurative diagram of a lighting control device for a vehicle lighting equipment showing a fourth embodiment of the present invention, and FIG. 6 is a pertinent circuit configurative diagram of a control circuit in the fourth embodiment of the present invention.

In FIG. 1, a vehicle lighting equipment (light emitting device) 10 includes an LED 1 to an LED 8 constituting five types of light sources, for example, as a multifunctional lamp. The LED 1 to the LED 3 are constructed as a low-beam headlamp, the LED 4 and the LED 5 are constructed as a high-beam headlamp, the LED 6 is constructed as a cornering lamp, the LED 7 is constructed as a turn signal lamp, and the LED 8 is constructed as DRL (Daytime Running Lamp).

A lighting control device 12 of the vehicle lighting equipment for controlling lighting of the multifunctional lamp is constructed to include a switching regulator 14 for supplying a voltage to the LED 1 to the LED 4 respectively, a switching regulator 16 for supplying a voltage to the LED 5 to the LED 8 respectively, a controlling portion 18 for generating control signals that are used to turn ON/OFF the LED 1 to the LED 8 individually in response to communication information from the outside, and the like, current setting portions (current setting means) 20, 22 for setting a maximum current value used to current-drive the LED 1 to the LED 8 separately in two stages in response to the assignment, and current driving portions (current driving means) 24, 26, 28, 30, 32, 34, 36, 38 connected in series with the LED 1 to the LED 8 respectively to adjust driving currents of the LED 1 to the LED 8 individually.

The LED 1 to the LED 4 are connected in parallel with each other as the semiconductor light sources constructed by the semiconductor light emitting elements, and are connected in series with the current driving portions 24, 26, 28, 30 on the output side of the switching regulator 14. The LED 5 to the LED 8 are connected in parallel with each other as the semiconductor light sources constructed by the semiconductor light emitting elements, and are connected in series with the current driving portions 32, 34, 36, 38 on the output side of the switching regulator 16.

As the LED 1 to the LED 8, a plurality of LEDs connected in series with each other or a plurality of LEDs connected in parallel with each other may be used. Also, the LED 1 to the LED 8 can be constructed as the light sources of various vehicle lighting equipments such as stop & tail lamp, fog lamp, clearance lamp (small lamp), and the like.

The switching regulators 14, 16 have the same circuit configuration, and constructed to have capacitors C1, C2, a transformer T1, a diode D1, an NMOS transistor 40, and a control circuit 42 respectively. Both end sides of the capacitor C1 are connected to power supply input terminals 44, 46. A connection point between the diode D1 and the capacitor C2 is connected to a light source terminal 48 or a light source terminal 50 and the control circuit 42 respectively. The power supply input terminal 44 is connected to a positive terminal of an onboard battery (IC power supply) 52. The power supply input terminal 46 is grounded and is connected to a negative terminal of the onboard battery 52.

Each of the switching regulators 14, 16 is constructed by an IC Integrated Circuit), for example. The NMOS transistor 40 is turned ON/OFF by a switching signal output from the control circuit 42 that has a function as an arithmetic unit, e.g., a switching signal at a frequency of several tens kHz to several hundreds kHz. When the NMOS transistor 40 is turned ON/OFF by the switching signal, a DC current generated by the ON/OFF operation flows from the power supply input terminal 44 to a primary winding L1 of the transformer T1, the NMOS transistor 40, and the power supply input terminal 46, and an AC voltage is generated across a secondary winding L2. The AC voltage generated in the secondary winding L2 is rectified by the diode D1 and is smoothed by the capacitor C2. The smoothed DC voltage is supplied from the light source terminal 48 to the LED 1 to the LED 4 or from the light source terminal 50 to the LED 5 to the LED 8.

Also, output voltages E1, E2 of the switching regulators 14, 16 are controlled by the control circuit 42 respectively. Specifically, the control circuit 42 of the switching regulator 14 monitors the output voltage E1 of the switching regulator 14 based on the voltage E1 of a line L11 and also monitors controlled states of the current driving portions 24, 26, 28, 30 based on voltages of lines L12, L13, L14, L15. Then, the control circuit 42 of the switching regulator 14 controls the output voltage E1 based on the voltages of the lines L11 to L15 such that this output voltage E1 coincides with a voltage of the series circuit which has the highest voltage, out of four system series circuits that are constructed by the LED 1 to the LED 4 and the current driving portions 24, 26, 28, 30 respectively.

Similarly, the control circuit 42 of the switching regulator 16 monitors the output voltage E2 of the switching regulator 16 based on the voltage P2 of a line L21 and also monitors controlled states of the current driving portions 32, 34, 36, 38 based on voltages of lines L22, L23, L24, L25. Then, the control circuit 42 of the switching regulator 16 controls the output voltage E2 based on the voltages of the lines L21 to L25 such that this output voltage E1 coincides with a voltage of the series circuit, which has the highest voltage, out of four system series circuits that are constructed by the LED 5 to the LED 8 and the current driving portions 32, 34, 36, 38 respectively.

The controlling portion 18 is constructed by a microcomputer that is equipped with CPU (Central Processing Unit), RAM (Random Access Memory), ROM Read Only Memory), I/O (Input/Output) interface circuit, and the like, for example. The input side of the controlling portion 18 is connected to a vehicle electronic control unit (ECU) via a communication terminal 54 and a wire harness (not shown).

When digital communication information is input from the vehicle electronic control unit (ECU) as external communication information, this controlling portion 18 identifies this digital communication information and then generates and outputs a control signal according to the identified result. For example, when digital communication information used to set currents regarding to the current driving portions 24 to 38 is input, the controlling portion 18 identifies this digital communication information and then outputs control signals 100, 102, which are used to assign the maximum current value corresponding to a plurality of lighting modes separately in two stages, to the current setting portions 20, 22 as the control signal according to the identified result respectively.

Also, when digital communication information for turning ON/OFF and dimming the LED 1 to the LED 8 individually is input this controlling portion 18 identifies this digital communication information, and then outputs control signals 104, 106, 108, 110, 112, 114, 116, 118, which are used to assign the ON/OFF periods of the LED 1 to the LED 8 in respective lighting modes, to the current driving portions 24, 26, 28, 30, 32, 34, 36, 38 as the control signals according to the identified result respectively.

The control signals 100, 102 are generated as a signal whose level is different, e.g., a high-level or low-level signal, respectively according to the identified result of the digital communication information. The control signals 104 to 118 are generated as a signal whose level is different or a signal whose duty ratio is set according to the identified result of the digital communication information respectively. For example, the control signals 104 to 118 corresponding to the LEDs that are to be turned ON are generated as a low-level signal respectively, the control signals 104 to 118 corresponding to the LEDs that are to be turned OFF are generated as a high-level signal respectively, and the control signals 104 to 118 corresponding to the LEDs that are to be turned ON in a dimmed state (be dimmed) are generated as an ON/OFF signal whose duty ratio is several 10% (PWM signal) respectively.

The current setting portions 20, 22 have the same circuit configuration respectively, and are constructed to have an NPN transistor 56, an operational amplifier (operational amplifier buffer) 58, and resistors R1, R2, R3, R4, R5 respectively. The NPN transistor 56 is constructed as a switching element, and its emitter is grounded, its base is connected to the controlling portion 18 via the resistor R2, and its collector is connected to a positive input terminal of the operational amplifier 58 via the resistor R5. A positive input terminal of the operational amplifier 58 is connected to a connection point between the resistor R4 and the resistor R5, and a negative input terminal and an output terminal of the operational amplifier 58 are connected to the current driving portions 24 to 38 respectively.

The NPN transistor 56 is turned ON/OFF in response to the control signals 100, 102 output from the controlling portion 18. For example, the NPN transistor 56 is turned ON in response to the control signals 100, 102 at a high level, and is turned OFF in response to the control signals at a low level. When the NPN transistor 56 is turned ON, a voltage VDD is divided by the resistor R4 and the resistor R5, and then the divided voltage is applied to the positive input terminal of the operational amplifier 58. As a result, a voltage VL corresponding to a voltage that is applied to the positive input terminal is applied (distributed) from the operational amplifier 58 to the current driving portions 24 to 38 as a voltage (power supply voltage) that is used to turn ON the LED 1 to the LED 8 at 1 A, for example.

In contrast, when the NPN transistor 56 is turned OFF, the voltage VDD is applied to the positive input terminal of the operational amplifier 58 via the resistor R4. As a result, a voltage VH (VL<VH) corresponding to the voltage that is applied to the positive input terminal is applied (distributed) from the operational amplifier 58 to the current driving portions 24 to 38 as a voltage (power supply voltage) that is used to turn ON the LED 1 to the LED 8 at 1.6 A, for example.

In other words, the current setting portions 20, 22 set the maximum current value of the currents flowing through the LED 1 to the LED 4 or the LED 5 to the LED 8 separately in two stages respectively. Therefore, the current setting portions 20, 22 are constructed as a current setting means that applies the voltage VL or VH to the current driving portions 24 to 30 or the current driving portions 32 to 38 as the power supply voltage in response to the control signals 100, 102.

Here, the current setting portions 20, 22 have the same circuit configuration. In this case, when resistance values of the resistors R4, R5 and an amplification degree of the operational amplifier 58 are set to a different value in the current setting portions 20, 22, the output voltages VL, VH of the current setting portions 20, 22 can be set to a different value respectively.

For example, the output voltages VL, VH of the current setting portion 20 can be set to VL1, VH1 (VL1<VH1) respectively, and the output voltages VL, VH of the current setting portion 22 can be set to VL2, V (VL2<VH2) respectively. Also, the voltage VH1 can be set as a power supply voltage that is used to turn ON any of the LED 1 to the LED 4 at 1.6 A, the voltage VH2 can be set as a power supply voltage that is used to turn ON any of the LED 5 to the LED 8 at 1.3 A, the voltage VL1 can be set as a power supply voltage that is used to turn ON any of the LED 1 to the LED 4 at 1 A, and the voltage VL2 can be set as a power supply voltage that is used to tarn ON any of the LED 5 to the LED 8 at 1 A.

The current driving portions (series regulators) 24 to 38 have the same circuit configuration respectively, and are constructed to have a PNP transistor 60, an operational amplifier 62, an NMOS transistor 64, a shunt resistor Rs, and resistors R7, R8, R9, R10. The NMOS transistor 64 is constructed as a switching means, and is connected in series with the shunt resistor Rs and are connected in series with the LED 1 to the LED 8 via light source terminals 66, 68, 70, 72, 74, 76, 78, 80 respectively.

Here, in place of the NMOS transistor 64, other switching element, e.g., the NPN transistor, can be used as the switching element.

The shunt resistor Rs is constructed as a current detecting element that converts the current flowing through the LED 1 to the LED 8 respectively into the voltage and inputs this voltage into the negative input terminal of the operational amplifier 62. The operational amplifier 62 receives a voltage generated at a connection point between the resistor R9 and the resistor R10 at its positive input terminal, and receives a voltage across the shunt resistor Rs at its negative input terminal. Then, the operational amplifier 62 compares both voltages mutually, generates a gate voltage (control signal) in response to the compared result and applies this gate voltage to the gate of the NMOS transistor 64 to control the ON/OFF operation of the NMOS transistor 64.

In other words, the current driving portions 24 to 38 control the ON/OFF operation of the NMOS transistor 64 in response to the compared result of the operational amplifier 62, and thus control the currents of the LED 1 to the LED a individually such that a normal current flows through the LED 1 to the LED 8 respectively.

For example, when the digital communication information used to turn ON all low-beam headlamps is input from the vehicle electronic control unit (ECU) to the controlling portion 18 as the external communication information and then the low-level signal is output from the controlling portion 18 as the control signals 104, 106, 108, the PNP transistors 60 of the current driving portions 24, 26, 28 are turned ON respectively. Then, voltages obtained by dividing the output voltages of the current setting portions 20, 22 by the resistor R9 and the resistor R10 are input into the positive input terminal of the operational amplifier 62 as a reference voltage. At this time, the operational amplifier 62 outputs a voltage (proper voltage) that makes the voltage across the shunt resistor Rs coincide with the reference voltage. Accordingly, the NMOS transistor 64 is turned ON, the normal current flows trough the LED 1 to the LED 3 respectively, and the LED 1 to the LED 3 are turned ON.

For example, in a certain lighting mode, a current of 1 A flows through the LED 1 to the LED 3 when the voltage VL1 is applied to the current driving portions 24, 26, 28, while a current of 1.6 A flows through the LED 1 to the LED 3 when the voltage VH1 is applied to the current driving portions 24, 26, 28.

In contrast, when the digital communication information used to turn OFF all low-beam headlamps is input from the vehicle electronic control unit (ECU) to the controlling portion 18 and then the high-level signal is output from the controlling portion 18 as the control signals 104, 106, 108, the PNP transistors 60 of the current driving portions 24, 26, 28 are turned OFF respectively. Then, no voltage is applied to the positive input terminal of the operational amplifier 62. Therefore, a low-level voltage is output from the operational amplifier 62, then the NMOS transistor 64 is turned OFF, and ten the LED 1 to the LED 3 are turned OFF.

Also, when the digital communication information used to turn ON all low-beam headlamps in a dimmed state (to dim) is input from the vehicle electronic control unit (ECU) to the controlling portion 18 and then the ON/OFF signal (PWM signal) whose duty ratio is several tens % is output from the controlling portion 18 as the control signals 104, 106, 108, the PNP transistors 60 of the current driving portions 24, 26, 28 repeat the ON/OFF operation in response to the ON/OFF signal (PWM signal) respectively. Thus, the proper voltage (voltage that makes the voltage across the shunt resistor Rs coincide with the reference voltage) and the low-level voltage are output alternately from the operational amplifier 62, and the NMOS transistor 64 repeats the ON/OFF operation. Therefore, the LED 1 to the LED 3 are turned ON in a dimmed state in response to the ON/OFF operation of the NMOS transistor 64.

Similarly, when the digital communication information used to turn OB all high-beam headlamps or the cornering lamp, the turn signal lamp, and the DLR is input from the vehicle electronic control unit (ECU) to the controlling portion 18 and then the low-level signal is output from the controlling portion 18 as the control signals 110, 112 or the control signals 114, 116, 118, the PNP transistors 60 of the current driving portions 30, 32 or the current driving portions 34, 36, 38 are turned ON respectively. Also, the NMOS transistor 64 is turned ON, and then the LED 4 and the LED 5 or the LED 6 to the LED 8 are turned ON.

Also, when the high-level signal is output from the controlling portion 18 as the control signals 110, 112 or the control signals 114, 116, 118, the LED 4 and the LED 5 or the LED 6 to the LED 8 are turned OFF. Also, when the ON/OFF signal whose duty ratio is several tens % is output from the controlling portion 18 as the control signals 110, 112 or the control signals 114, 116, 118, the LED 4 and the LED 5 or the LED 6 to the LED 8 are turned ON in a dimmed state.

In other words, in the controlling portion 18, the digital communication information from the vehicle electronic control unit (ECU) is identified and then the control signals 104 to 118 are output to the current driving portions 24 to 38 according to the identified result. Therefore, the LED 1 to the LED 8 can be turned ON/OFF and turned ON in a dimmed state individually.

Also, in the current driving portions 24 to 30 or the current driving portions 32 to 38, in course of control that is applied to flow the normal current through the LED 1 to the LED 4 or the LED 5 to the LED 8 respectively, a gate voltage (proper voltage) of the NMOS transistor 64 becomes close to a threshold voltage, e.g., 2 V to 3 V. At this time, when the current flowing through any one LED of the LED 1 to the LED 4 or the LED 5 to the LED 8 is below the normal current, the gate voltage of the NMOS transistors 64 connected to the LED 1 to the LED 4 or the LED 5 to the LED 8 is increased. When the gate voltage of any one of NMOS transistors 64 is increased (any voltage of the lines L12 to L15 or the lines L22 to L25 is increased), the control circuit 42 of the switching regulator 14 or 16 controls the ON/OFF operation of the NMOS transistors 64 such that the output voltage of the switching regulator 14 or 16 is increased.

Then, when the gate voltage of all NMOS transistors 64 connected to the LED 1 to the LED 4 or the LED 5 to the LED 8 becomes low to the almost same extent as the threshold voltage, the switching operation of the NMOS transistor 40 is controlled such that the output of the switching regulator 14 or 16 is lowered. Therefore, the switching regulator 14 or 16 can control the output voltage close to the voltage whose variation of Vf (forward voltage) is highest in the LED 1 to the LED 4 or the LED 5 to the LED 8.

Here, when tree types of lighting modes are set to the LED 1 to the LED 4, for example, when a lighting mode 1 in which the LED 1 to the LED 4 are turned ON at 1 A respectively, a lighting mode 2 in which the LED 1, the LED 2 are turned ON at 1 A respectively and the LED 3, the LED 4 are turned ON at 0.8 A respectively, and a lighting mode 3 in which the LED 1 is turned ON at 1.6 A and the LED 2 to the LED 4 are turned ON at 1 A respectively are set, the controlling portion 18 controls respective lighting of the LED 1 to the LED 4 by generating the control signals corresponding to respective lighting modes 1 to 3 based on the digital communication information.

For example, in the lighting mode 1, the controlling portion 18 generates the high-level control signal 100 and generates the low-level control signals 104 to 110 to assign the ON periods of the NMOS transistors 64 or the LED 1 to the LED 4 (the period in which the NMOS transistors 64 continue to perform the ON operation), and outputs the high-level control signal 100 to the current setting portion 20 and outputs the low-level control signals 104 to 110 to the current driving portions 24 to 30. Accordingly, the output voltage of the current setting portion 20 is set to the voltage VL1, and the PNP transistors 60 of the current driving portions 24 to 30 are turned ON according to this voltage VL1. Therefore, a current of 1 A flows through the LED 1 to the LED 4 respectively, and the LED 1 to the LED 4 are turned ON.

In the lighting mode 2, the controlling portion 18 generates the high-level control signal 100, generates the low-level control signals 104, 106, and generates the control signals 108, 110 whose duty ratio is set respectively to assign the ON/OFF periods of the NMOS transistors 64 or the LED 1 to the LED 4 (the period in which the NMOS transistors 64 perform the ON/OFF operation), and outputs the high-level control signal 100 to the current setting portion 20, outputs the low-level control signals 104, 106 to the current driving portions 24, 26, and outputs the control signals 108, 110 whose duty ratio is set respectively to the current driving portions 28, 30. In this case, because the current of 0.8 A corresponds to 80.0% in a condition that the maximum current value of 1 A corresponding to VL1 is set as 100%, a duty ratio of the control signals 108, 110 used to cause the PNP transistor 60 to perform the ON/OFF operation becomes 20.0%. Here, when the NPN transistor should be caused to perform the ON/OFF operation instead of the PNP transistor 60, a duty ratio of the control signals 108, 110 corresponding to 0.8 A becomes 80.0%.

The output voltage of the current setting portion 20 is set to the voltage VL1 by the high-level control signal 100. The PNP transistors 60 of the current driving portions 24, 26 are turned ON according to the low-level control signals 104, 106 while using this voltage VL1 as the power supply voltage. Also, the PNP transistors 60 of the current driving portions 28, 30 perform the ON/OFF operation according to the control signals (PWM signals) 108, 110 whose duty ratio is 200% respectively. Therefore, a current of 1 A flows through the LED 1, the LED 2 respectively, and the LED 1, the LED 2 are turned ON. In contrast a current of 0.8 A flows through the LED 3, the LED 4 on average respectively, and the LED 3, the LED 4 are turned ON in a dimmed state.

In the lighting mode 3, the controlling portion 18 generates the low-level control signal 100 and generates the low-level control signal 104 and the control signals 106, 108, 110 whose duty ratio is set respectively, and outputs the low-level control signal 100 to the current setting portion 20, outputs the low-level control signal 104 to the current driving portion 24, and outputs the control signals 106, 108, 110 whose duty ratio is set to the current driving portions 26, 28, 30. In this case, because the current of 1 A corresponds to 62.5% in a condition that the current value of 1.6 A is set as 100%, a duty ratio of the control signals 106, 108, 110 used to cause the PNP transistor 60 to perform the ON/OFF operation becomes 37.5%. Here, when the NPN transistor should be caused to perform the ON/OFF operation instead of the PNP transistor 60, a duty ratio of the control signals 106, 108, 110 corresponding to 1 A becomes 62.5%. The output voltage of the current setting portion 20 is set to the voltage VH1 corresponding to the maximum current value 1.6 A by the low-level control signal 100. The PNP transistor 60 of the current driving portion 24 is turned ON according to the low-level control signal 104 while using this voltage VH1 as the power supply voltage, and the PNP transistors 60 of the current driving portions 20, 28, 30 perform the ON/OFF operation according to the control signals (PWM signals) 106, 108, 110 whose duty ratio is 37.5% respectively. Therefore, a current of 1.6 A flows through the LED 1, and the LED 1 is turned ON. In contrast, a current of 1 A flows through the LED 2 to the LED 4 on average respectively, and the LED 2 to the LED 4 are turned ON in a dimmed state.

In the above example, when the LED 1 to the LED 4 are turned ON in a dimmed state, the LED current is not reduced directly as a DC current, but instead, the PWM signal whose duty ratio is set is used. Also, with respect to the PWM signal, the PWM signal whose duty ratio is set is used as the control signals 108, 110 when the LED 3 and the LED 4 are turned ON in a dimmed state in the lighting mode 2, and the PWM signal whose duty ratio is set is used as the control signals 106 to 110 when the LED 2 to the LED 4 are turned ON in a dimmed state in the lighting mode 3. In remaining conditions, the low-level signal is used as the control signals 104 to 110.

In this manner, when the lighting of the LED 1 to the LED 4 are controlled in response to the lighting modes 1 to 3, the power supply voltage VL1 or VH1 corresponding to the maximum current value of the LED that is to be turned ON in respective lighting modes 1 to 3 is set by the current setting portion 20, the LED is turned ON based on the set power supply voltage, and the PWM signal is used only when the LED is turned ON in a dimmed state. As a result a loss in the NMOS transistor 64 can be reduced, and also it can be suppressed that a current precision of the current that flows through the LED 1 to the LED 4 is degraded.

Here, as the lighting mode 1 regarding to the LED 1 to the LED 4, such a mode may be employed that the LED 1, the LED 2 are turned ON at 0.8 A respectively and the LED 3, the LED 4 are turned ON at 1 A respectively. In this case, the controlling portion 18 generates the high-level control signal 100 and generates the control signals 104, 106 whose duty ratio is set to 20.0% respectively and the low-level control signals 108, 110, and outputs the high-level control signal 100 to the current setting portion 20, outputs the control signals 104, 106 whose duty ratio is set to 20.0% respectively to the current driving portions 24, 26, and outputs the low-level control signals 108, 110 to the current driving portions 28, 30.

In contrast, when three types of lighting modes regarding the LED 5 to the LED 8 are set for example, the lighting mode 1 in which the LED 5 is turned ON at 0.8 A, the LED 6 and the LED 7 are turned ON at 1 A respectively, and the LED 8 is turned ON at 0.8 A, the lighting mode 2 in which the LED 5 to the LED 8 are turned ON at 1 A respectively, and the lighting mode 3 in which the LED 5 is turned ON at 1.3 A and the LED 6 to the LED 8 are turned ON at 1 A respectively are set, the controlling portion 18 controls the lighting of the LED 5 to the LED 8 by generating the control signals corresponding to respective lighting modes 1 to 3 based on the digital communication information.

For example, in the lighting mode 1, the controlling portion 18 generates the high-level control signal 102 and generates the control signals 112, 118 whose duty ratio is set to 20.0% respectively and the low-level control signals 114, 116, and outputs the high-level control signal 102 to the current setting portion 22, outputs the control signals 112, 118 whose duty ratio is set to 20.0% respectively to the current driving portions 32, 38, and outputs the low-level control signals 114, 116 to the current driving portions 34, 36. As a result, the output voltage of the current setting portion 22 is set to the voltage VL2 corresponding to the maximum current value 1 A.

While using this voltage VL2 as the power supply voltage, the PNP transistors 60 of the current driving portions 32, 38 perform the ON/OFF operation according to the control signals 112, 118 whose duty ratio is set to 20.0% respectively, and the PNP transistors 60 of the current driving portions 34, 36 perform the ON/OFF operation according to the low-level control signals 114, 116. Therefore, a current of 0.8 A flows through the LED 5 and the LED 8 on average, and the LED 5 and the LED 8 are turned ON in a dimmed state. Similarly, a current of 1 A flows through the LED 6 and the LED 7, and the LED 6 and the LED 7 are turned ON. In this case, because the current of 0.8 A corresponds to 80.0% in a condition that the current value of 1 A is set as 100%, a duty ratio of the control signals 112, 118 that are applied to cause the PNP transistors 60 to perform the ON/OFF operation becomes 20.0%.

In the lighting mode 2, the controlling portion 18 generates the high-level control signal 102 and generates the low-level control signals 112, 114, 116, 118, and outputs the high-level control signal 102 to the current setting portion 22 and outputs the low-level control signals 112 to 118 to the current driving portions 32 to 38. As a result, the output voltage of the current setting portion 22 is set to the voltage VL2 corresponding to the maximum current value 1 A.

While using this voltage VL2 as the power supply voltage, the PNP transistors 60 of the current driving portions 32 to 38 perform the ON operation according to the low-level control signals 112 to 118. Therefore, a current of 1 A flows through the LED 5 to the LED 8, and the LED 5 to the LED 8 are turned ON.

In the lighting mode 3, the controlling portion 18 generates the low-level control signal 102 and generates the low-level control signal 112 and the control signals 114, 116, 118 whose duty ratio is set to 23.1% respectively, and outputs the low-level control signal 102 to the current setting portion 22, outputs the low-level control signal 112 to the current driving portion 32, and outputs the control signals 114, 116, 118 whose duty ratio is set to 23.1% respectively to the current driving portions 34, 36, 38. In this case, because the current of 1 A corresponds to 76.9% in a condition that the current value of 1.3 A is set as 100%, a duty ratio of the control signals 114, 116, 118 that are applied to cause the PNP transistors 60 to perform the ON/OFF operation becomes 23.1%.

The output voltage of the current setting portion 22 is set to the voltage VH2 corresponding to the maximum current 1.3 A by the low-level control signal 102. The PNP transistors 60 of the current driving portion 32 is turned ON according to the low-level control signal 112 while using this voltage VH2 as the power supply voltage. Also, the PNP transistors 60 of the current driving portions 34, 36, 38 perform the ON/OFF operation according to the control signals (PWM signals) 114, 116, 118 whose duty ratio is 23.1% respectively. Therefore, a current of 1.3 A flows through the LED 5, and the LED 5 is turned ON. In contrast, a current of 1 A flows through the LED 6 to the LED 8 on average respectively, and the LED 6 to the LED 8 are turned ON in a dimmed state.

In the above example, when the LED 5 to the LED 8 are turned ON in a dimmed state, the LED current is not reduced directly as a DC current, but instead, the PWM signal whose duty ratio is set is used. Also, with respect to the PWM signal, the PWM signal whose duty ratio is set is used as the control signals 114, 116 when the LED 5 and the LED 8 are turned ON in a dimmed state in the lighting mode 1, and the PWM signal whose duty ratio is set is used as the control signals 114 to 118 when the LED 6 to the LED 8 are turned ON in a dimmed state in the lighting mode 3. In remaining conditions, the low-level signal is used as the control signals 112 to 118.

In this manner, when the lighting of the LED 5 to the LED 8 are controlled in response to the lighting modes 1 to 3, the power supply voltage VL2 or VH2 corresponding to the maximum current value of the LED that is to be turned ON in respective lighting modes 1 to 3 is set by the current setting portion 22, the LED is turned ON based on the set power supply voltage, and the PWM signal is used only when the LED is turned ON in a dimmed state. As a result a loss in the NMOS transistor 64 can be reduced, and also it can be suppressed that a current precision of the current that flows through the LED 5 to the LED 8 is degraded.

According to the present embodiment, when the lighting of the LED 1 to the LED 8 is controlled in response to the lighting modes 1 to 3, the power supply voltage VL1/VL2 or VL1/VH2 corresponding to the maximum current value of the LED that is to be turned ON in respective lighting modes 1 to 3 is set by the current setting portion 20 or 22, the LED is turned ON based on the set power supply voltage, and the PWM signal is used only when the LED is turned ON in a dimmed state. As a result a loss in the NMOS transistor 64 can be reduced, and also it can be suppressed that a current precision of the current that flows through the LED 1 to the LED 8 is degraded.

Next, a second embodiment of the present invention will be explained with reference to FIG. 2 and FIG. 3 hereafter. In the present embodiment in generating the control signals 104 to 118 to control the lighting of the LED 1 to the LED 8 from the controlling portion 18, not only the control signals 104 to 118 for turning ON/OFF and turning ON in a dimmed state are generated by using three timers A, B, C instead of eight timers corresponding to eight types of control signals 104 to 118 as the timers of a microcomputer 18*a* being built in the controlling portion 18, but also, the control signals 104 to 118 for turning OFF are generated using the I/O signals of the microcomputer 18*a*. The remaining configurations are similar to those in the first embodiment. In FIG. 3, only a configuration used to control the lighting of the LED 1, the LED 2, the LED 5, the LED 8 is shown.

Specifically, as shown in FIG. 2(*a*), when three types of lighting modes are set with respect to the LED 1 to the LED 8, for example, a lighting mode 1 in which the LED 1 and the LED 2 are turned ON at 0.8 A respectively, the LED 3 and the LED 4 are turned ON at 1 A respectively, the LED 5 is turned ON at 0.8 A, the LED 6 is turned ON at 1 A, and the LED 7 and the LED 8 are turned OFF (0 A) respectively, a lighting mode 2 in which the LED 1 and the LED 2 are turned ON at 1 A respectively, the LED 3 is turned ON at 0.8 A, the LED 4 is turned OFF (0 A), the LED 5 and the LED 6 are turned OFF (0 A) respectively, and the LED 7 and the LED 8 are turned ON at 1 A respectively, and a lighting mode 3 in which the LED 1 is turned ON at 1.6 A, the LED 2 and the LED 3 are turned OFF (0 A) respectively, the LED 4 is turned ON at 1 A, the LED 5 is turned ON at 1.3 A, the LED 6 and the LED 7 are turned ON at 1 A respectively, and the LED 8 is turned OFF (0 A) are set, an average current flowing through the LED 1 to the LED 8 is represented by a duty ratio of PWM, as shown in FIG. 2(*b*).

At this time, suppose that the I/O signal is used to 0% that signifies the turn OFF, the LED 1 to the LED 8 can be divided into plural groups in response to a duty ratio of PWM. For example, in the lighting mode 1, the LED 1 to the LED 8 can be divided into two groups of 80% and 100%. Also, in the lighting mode 2, the LED 1 to the LED 8 can be divided into two groups of 80% and 100%. In contrast, the lighting mode 3, the LED 1 to the LED 8 can be divided into three groups of 62.5%, 76.9%, and 100%.

In view of the fact that the LEDs are classified into three groups at the maximum, as shown in FIG. 2(*c*), the LEDs are classified into three groups of 80%, 100%, and 100% in the lighting mode 1, the LEDs are classified into three groups of 100%, 100%, and 80% in the lighting mode 1, and the LEDs are classified into three groups of 100%, 76.9%, and 62.5% in the lighting mode 3.

Therefore, the timer A carries out generation of the control signals to control the lighting of the LED 1, the LED 2, the LED 5, and the LED 8 belonging to the first group, the timer B carries out generation of the control signals to control the lighting of the LED 6 and the LED 7 belonging to the second group, and the timer C carries out generation of the control signals to control the lighting of the LED 3 and the LED 4 belonging to the third group.

Upon generating the control signals by utilizing the timers and the I/O signals, the timers A, B, C (not shown) are built in the microcomputer 18*a* of the controlling portion 18, and timer terminals TA, TB, TC (only TA is illustrated) used to output the signals of the timers A, B, C, and I/O terminals T1 to T8 (only T1, T2, T5, T8 are illustrated) used to output the I/O signal to the current driving portions 24 to 38 are provided. Also, resistors R11, R12, R13, R14 and diodes D11, D12, D13, D14 are provided to the controlling portion 18 to correspond to the timer A. One terminals sides of the resistors R11 to R14 are connected to the timer terminal TA, and the other terminals sides are connected to the resistors R8 of the current driving portions 24, 26, 32, 38 respectively. Anode sides of the diodes D11 to D14 are connected to the I/O terminal T1, the I/O terminal T2, the I/O terminal T5, the I/O terminal T8 respectively, and cathode sides are connected to the resistors R8 of the current driving portions 24, 26, 32, 38 respectively.

Here, upon controlling the lighting of the LED 1, the LED 2, the LED 5, the LED 4 belonging to the first group, in the lighting mode 1, in order to turn ON the LED 1, the LED 2, and the LED 5 in a dimmed state at a quantity of light of 80%, the control signals 104, 106, 112 whose duty ratio is 20% respectively are output from the timer A (timer terminal TA) via the resistor R11, the resistor R12, and the resistor R13, so that the LED 1, the LED 2, and the LED 5 are turned ON in a dimmed state at a quantity of light of 80%. At this time, the I/O signal output from the I/O terminal T8 is output via the diode D14 as the high-level control signal 118, the PNP transistor 60 of the current driving portion 38 is turned OFF, and the LED 8 is turned OFF.

In the lighting mode 2, in order to turn ON the LED 1, the LED 2, and the LED 8 at a quantity of light of 100%, the low-level control signals 104, 106, 118 are output from the timer A (timer terminal TA) via the resistor R1, the resistor R12, and the resistor R14, so that the LED 1, the LED 2, and the LED 8 are turned ON at a quantity of light of 100% (where the power supply voltages of the current setting portions 20, 22 are set to VL1 or VL2). At this time, the I/O signal output from the I/O terminal T5 is output via the diode D13 as the high-level control signal 112, the PNP transistor 60 of the current driving portion 32 is turned OFF, and the LED 5 is turned OFF.

In the lighting mode 3, in order to turn ON the LED 1 and the LED 5 at a quantity of light of 100%, the low-level control signals 104, 112 are output from the timer A (timer terminal TA) via the resistor R11 and the resistor R13, so that the LED 1 and the LED 5 are turned ON at a quantity of light of 100% (where the power supply voltages of the current setting portions 20, 22 are set to VH1 or VH2). At this time, the I/O signals output from the I/O terminals T2, T8 are output via the diodes D12, D14 as the high-level control signals 106, 118 respectively, the PNP transistors 60 of the current driving portions 26, 38 are turned OFF, and the LED 2 and the LED 8 are turned OFF.

According to the present embodiment, when the lighting of the LED 1 to the LED 8 is controlled in response to the lighting modes 1 to 3, the power supply voltage VL1/VL2 or VL1/VH2 corresponding to the maximum current value of the LED that is to be turned ON in respective lighting modes 1 to 3 is set by the current setting portion 20 or 22, the LED is turned ON based on the set power supply voltage, and the PWM signal is used only when the LED is turned ON in a dimmed state. As a result, a loss in the NMOS transistor 64 can be reduced, and also it can be suppressed that a current precision of the current that flows through the LED 1 to the LED 8 is degraded.

Also, in the present embodiment, such a configuration is employed that the current driving portions 24 to 38 are classified into three groups such that the current driving portions used commonly in all lighting modes 1 to 3 should be classified into the same groups, the current driving portions 24 to 38 in respective groups (24, 26, 32, 38), (28, 30), (34, 36) are connected electrically mutually (for example, the current driving portions 24, 26, 32, 38 are connected electrically mutually via the resistors R11 to R14), the ON/OFF period of the NMOS transistor 64 is assigned to the current driving portions, which are connected to the LEDs as the turned-ON objects and the dimmed objects, out of the current driving portions in respective groups under the same driving condition every group, and also the OFF drive is assigned to the current driving portions that are connected to the LEDs as the turned-OFF objects based on the different elements (I/O signals) from the elements (timers A, B, C) that are used to assign the ON/OFF periods of the NMOS transistors 64.

Therefore, according to the present embodiment, upon generating the control signals 104 to 118 to control the lighting of the LED 1 to the LED 8 in the controlling portion 18, the control signals 104 to 118 to turn OFF the LEDs are generated by using the I/O signals of the microcomputer 18*a*. As a result, the control signals 104 to 118 to turn ON the LEDs fully or in a dimmed state can be generated by using three timers A, B, C, instead of using eight timers, and the microcomputer in which the number of timers is smaller than that of the LED 1 to the LED 8 can be used as the microcomputer 18*a*.

Next, a third embodiment of the present invention will be explained with reference to FIG. 4 hereafter. In the present embodiment, four current setting portions 82 are provided to correspond to the current driving portions 24, 26, 28, 30 and the power supply voltage of the current driving portions 24, 26, 28, 30 is always set to VDD. Except that the switching regulator 16 and the driving systems for the LED 5 to the LED 8 are omitted herein, the present embodiment is similar to the first embodiment. Here, the present embodiment is applicable to the current driving portions 32 to 38.

Four current setting portions 82 have the same circuit configuration respectively, and are constructed to have resistors R21, 22, R23, R24 and an NPN transistor 84 respectively. An emitter of the NPN transistor 84 is grounded, a base thereof is connected to the controlling portion 18 via the resistor R21, and a collector thereof is connected to the positive input terminals of the operational amplifiers 62 of the current driving portions 24, 26, 28, 30 via the resistor R23 respectively.

The NPN transistor 84 performs the ON/OFF operation in response to the control signal 100 from the controlling portion 18. For example, the NPN transistor 84 is kept in its OFF state when a level of the control signal 100 is at a low level, and the NPN transistor 84 is turned ON when the level of the control signal 100 is inverted to a high level. When the control signals 104, 106, 108, 110 applied to the current driving portions 24, 26, 28, 30 go to a low level respectively in a situation the NPN transistor 84 is kept in its OFF state, the PNP transistors 60 of the current driving portions 24, 26, 28, are turned ON, and a voltage obtained by dividing the voltage VDD) by the resistor R9 and the resistor R10 is applied to the positive input terminal of the operational amplifier 62. At this time, the current driving portions 24, 26, 28, 30 drive/turn ON the LED 1 to the LED 4 at the maximum current value, e.g., 1.6 A, respectively.

In contrast when the NPN transistor 84 is turned ON in a situation that the voltage obtained by dividing the voltage VDD by the resistor R9 and the resistor R10 is being applied to the positive input terminal of the operational amplifier 62, the resistor R23 is connected in parallel with the resistors R10 of the current driving portions 24, 26, 28, 30, and the voltage of the positive input terminal of the operational amplifier 62 is lowered. Therefore, the current driving portions 24, 26, 28, 30 drive/turn ON the LED 1 to the LED 4 at the maximum current value, e.g., 1 A, respectively.

That is, in response to the control signal 100, each current setting portion 82 sets the maximum current values obtained by driving respective current driving portions 24, 26, 28, 30 large respectively (e.g., 1.6 A) when the NPN transistor 84 is turned OFF, and sets the maximum current values obtained by driving respective current driving portions 24, 26, 28, 30 small respectively (e.g., 1 A) when the NPN transistor 84 is turned ON.

In this case, when the resistance values of the resistors R23 of the current setting portions 82 are set to a different value respectively, the maximum current values obtained by driving respective current driving portions 24, 26, 28, 30 can be set to a different value respectively.

According to the present embodiment, when the lighting of the LED 1 to the LED 8 are controlled in response to the lighting modes 1 to 3, the maximum current value of the LED that is to be turned ON in respective lighting modes 1 to 3 is set to the LED 1 to the LED 4 by the current setting portion 82 respectively, the LED is turned ON based on the set maximum current value, and the PWM signal is used only when the LED is turned ON in a dimmed state. As a result, a loss in the NMOS transistor 64 can be reduced, and also it can be suppressed that a current precision of the current that flows through the LED 1 to the LED 8 is degraded.

Also, according to the present embodiment, only when the resistors R21 to R23 and the NPN transistors 84 are employed, the maximum current values obtained by driving the current driving portions 24, 26, 28, 30 can be set separately in two stages, the operational amplifier can be omitted, and a simplification of the configuration can be attained.

Next, a fourth embodiment of the present invention will be explained with reference to FIG. 5 and FIG. 6 hereafter. The present embodiment is constructed such that the LED 1 to the LED 4 are connected in series mutually, a current through the LED 1 to the LED 4 is detected by the shunt resistor Rs, and the current flowing through the LED 1 to the LED 4 is feedback-controlled such that the voltage across the shunt resistor Rs can be kept constant.

Specifically, current driving portions 86, 88, 90, 92 are connected in parallel with the LED 1 to the LED 4 instead of the current driving portions 24, 26, 28, 30, the LED 4 is grounded via the shunt resistor Rs, and the voltage generated across the shunt resistor Rs is fed-back to the control circuit 42 such that a function of the current setting portion 20 is added to the control circuit 42. Except the switching regulator 16 and the driving systems for the LED 5 to the LED 8 are omitted herein, the present embodiment is similar to the first embodiment.

The current driving portions 86, 88, 90, 92 are constructed by the semiconductor switching element respectively, for example, and also short-circuit or open both ends of the LED 1 to the LED 4 in response to the control signals 104, 106, 108, 110 from the controlling portion 18 respectively.

As shown in FIG. 6, in order to implement the function of the current setting portion, an error amplifier 94, an NPN transistor 96, and resistors R31, R32, R33, R34, R35 are provided to the control circuit 42. The voltage across the shunt resistor Rs is applied to the negative input terminal of the error amplifier 94, while the voltage across the resistor R35 is applied to the positive input terminal.

The NPN transistor 96 performs the ON/OFF operation in response to the control signal 100 from the controlling portion 18. For example, the NPN transistor 96 is kept in its OFF state when the control signal 100 is at a low level, and is turned ON when the control signal 100 is at a high level.

While the NPN transistor 96 is kept in its OFF state, the voltage obtained by dividing the voltage VDD by the resistor R33 and the resistor R35 is applied to the positive input terminal of the error amplifier 94 as a first reference voltage. At this time, the error amplifier 94 compares a voltage fed back from the shunt resistor Rs with the first reference voltage, and outputs a voltage generated in response to the compared result to a compare circuit (not shown). The compare circuit compares the output voltage of the error amplifier 94 with a sawtooth voltage, and outputs the switching signal to the NMOS transistor 40 in response to the compared result.

When the NMOS transistor 40 performs the ON/OFF operation in accordance with the switching signal, the current flowing through the LED 1 to the LED 4 is feedback-controlled such that the voltage across the shunt resistor Rs is kept constant. That is, the maximum value of the current (maximum current value) fed from the switching regulator 14 to the LED 1 to the LED 4 is decided by the first reference voltage.

In contrast, when the NPN transistor 96 is changed from its OFF state to its ON state, the resistor R34 is grounded via the NPN transistor 96. Therefore, the voltage obtained by dividing the voltage VDD by a combined resistor (combined resistance) consisting of the resistor R33, the resistor R34, and the resistor R35 is applied to the positive input terminal of the error amplifier 94 as a second reference voltage (second reference voltage<first reference voltage). At this time, the error amplifier 94 compares the voltage fed back from the shunt resistor Rs with the second reference voltage, and outputs a voltage generated in response to the compared result to the compare circuit (not shown). The compare circuit compares the output voltage of the error amplifier 94 with a sawtooth voltage, and outputs the switching signal to the NMOS transistor 40 in response to the compared result.

When the NMOS transistor 40 performs the ON/OFF operation in accordance with the switching signal, the current flowing through the LED 1 to the LED 4 is feedback-controlled such that the voltage across the shunt resistor Rs is kept constant. That is, the maximum value of the current (maximum current value) fed from the switching regulator 14 to the LED 1 to the LED 4 is decided by the second reference voltage. In this event the maximum current value decided based on the second reference voltage has a value smaller than the maximum current value decided based on the first reference voltage. In other words, in the switching regulator 14, the maximum value of the current (maximum current value) fed from the switching regulator 14 to the LED 1 to the LED 4 is decided separately in two stages in response to the first reference voltage or the second reference voltage.

Here, when three types of lighting modes regarding the LED 1 to the LED 4 are set, for example, the lighting mode 1 in which the LED 1 and the LED 4 are turned ON at 1 A respectively, the lighting mode 2 in which the LED 1, the LED 2 are turned ON at 1 A respectively and the LED 3, the LED 4 are turned ON at 0.8 A respectively, and the lighting mode 3 in which the LED 1 is turned ON at 1.6 A and the LED 2 to the LED 4 are turned ON at 1 A respectively are set, the controlling portion 18 controls the lighting of the LED 1 to the LED 4 by generating the control signals corresponding to respective lighting modes 1 to 3 based on the digital communication information.

For example, in the lighting mode 1, the controlling portion 18 generates the high-level control signal 100 and generates the low-level control signals 104 to 110, and outputs the high-level control signal 100 to the control circuit 42 and outputs the low-level control signals 104 to 110 to the current driving portions 86 to 92.

When the NPN transistor 96 of the control circuit 42 is turned ON in response to the high-level control signal 100, the second reference voltage is set as the reference voltage for the error amplifier 94. The semiconductor switching elements constituting the current driving portions 86 to 92, e.g., the NMOS transistors are turned OFF in response to the low-level control signals 104 to 110, and both ends of the LED 1 to the LED 4 are opened. Therefore, the maximum current value set based on the second reference voltage, e.g., 1 A, is supplied from the switching regulator 14 to the LED 1 to the LED 4. Then, a current of 1 A flows through the LED 1 to the LED 4, and the LED 1 to the LED 4 are turned ON. This current is detected by the shunt resistor Rs, and is fed back to the control circuit 42. Thus, such a control is carried out by the switching regulator 14 that the current of 1 A should always flow through the LED 1 to the LED 4.

In the lighting mode 2, the controlling portion 18 generates the high-level control signal 100 and generates the low-level control signals 104, 106 and the control signals 108, 110 whose duty ratio is set, and outputs the high-level control signal 100 to the control circuit 42, outputs the low-level control signals 104, 106 to the current driving portions 86, 88, and outputs the control signals 108, 110 whose duty ratio is set to the current driving portions 90, 92.

When the NPN transistor 96 of the control circuit 42 is turned ON by the high-level control signal 100, the second reference voltage is set as the reference voltage of the error amplifier 94. The NMOS transistors constituting the current driving portions 86, 88 are turned OFF in response to the low-level control signals 104, 106, and both ends of the LED 1 and the LED 2 are opened. At this time, the maximum current value set based on the second reference voltage, e.g., 1 A, is supplied from the switching regulator 14 to the LED 1 to the LED 4. Therefore, a current of 1 A flows through the LED 1 and the LED 2, and the LED 1 and the LED 2 are turned ON.

In contrast, the NMOS transistors of the current driving portions 90, 92 perform the ON/OFF operation in response to the control signals (PWM signals) 108, 110 whose duty ratio is set. Thus, both ends of the LED 3 and the LED 4 are opened/short-circuited in response to the ON/OFF operation of the current driving portions 90, 92 respectively. In this case, the current of 0.8 A corresponds to 80.0% in a condition that the maximum current value of 1 A corresponding to the second reference value is set as 100%. When the current driving portions 90, 92 are composed of the NMOS transistor respectively, for example, a duty ratio of the control signals 108, 110 used to cause the NMOS transistors to perform the ON/OFF operation becomes 20.0%. Therefore, a current of 0.8 A flows through the LED 3 and the LED 4 on average, and the LED 3 and the LED 4 are turned ON in a dimmed state.

In the lighting mode 3, the controlling portion 18 generates the low-level control signal 100 and generates the low-level control signal 104 and the control signals (PWM signals) 106, 108, 110 whose duty ratio is set, and outputs the low-level control signal 100 to the control circuit 42, outputs the low-level control signal 104 to the current driving portion 86, and outputs the control signals (PWM signals) 106, 108, 110 whose duty ratio is set to the current driving portions 88, 90, 92.

When the NPN transistor 96 of the control circuit 42 is turned OFF by the low-level control signal 100, the first reference voltage is set as the reference voltage of the error amplifier 94. The NMOS transistor constituting the current driving portion 86 is turned OFF in response to the low-level control signal 104, and both ends of the LED 1 are opened. At this time, the maximum current value set based on the first reference voltage, e.g., 1.6 A, is supplied from the switching regulator 14 to the LED 1 to the LED 4. Therefore, a current of 1.6 A flows through the LED 1, and the LED 1 is turned ON.

In contrast, the NMOS transistors of the current driving portions 88, 90, 92 perform the ON/OFF operation in response to the control signals (PWM signals) 106, 108, 110 whose duty ratio is set. Thus, both ends of the LED 2 to the LED 4 are opened/short-circuited in response to the ON/OFF operation of the current driving portions 88, 90, 92 respectively. In this case, the current of 1 A corresponds to 62.5% in a condition that the maximum current value of 1.6 A corresponding to the first reference value is set as 100%. Hence, a duty ratio of the control signals 106, 108, 110 used to cause the NMOS transistors to perform the ON/OFF operation becomes 37.5%. Therefore, a current of 1 A flows through the LED 2 to the LED 4 on average, and the LED 2 to the LED 4 are turned ON in a dimmed state.

In the above example, when the LED 1 to the LED 4 are turned ON in a dimmed state, the LED current is not reduced directly as a DC current, but instead, the PWM signal whose duty ratio is set is used. Also, with respect to the PWM signal, the PWM signal whose duty ratio is set is used as the control signals 108, 110 when the LED 3 and the LED 4 are turned ON in a dimmed state in the lighting mode 2, and the PWM signal whose duty ratio is set is used as the control signals 106 to 110 when the LED 2 to the LED 4 are turned ON in a dimmed state in the lighting mode 3. In remaining conditions, the low-level signal is used as the control signals 104 to 110.

According to the present embodiment when the lighting of the LED 1 to the LED 4 are controlled in response to the lighting modes 1 to 3, the maximum value of the current (maximum current value) to be fed to the LED 1 to the LED 4 is set by the control circuit 42 in respective lighting modes 1 to 3, the LED is turned ON based on the set maximum current value, and the PWM signal is used only when the LED is turned ON in a dimmed state. As a result, a loss in the NMOS transistors constituting the current driving portions 86 to 92 can be reduced, and also it can be suppressed that a current precision of the current that flows through the LED 1 to the LED 4 is degraded.

In the above embodiments, the case where the maximum current value used in current-driving the current driving portions 24 to 38 or the maximum current value of the current fed from the switching regulator 14 to the LED 1 to the LED 4 is set separately in two stages is explained. However, the maximum current value may be set more finely in three stages or four stages in place of two stages.

While description has been made in connection with exemplary embodiments of the present invention, those skilled in the art w111 understand that various changes and modification may be made therein without departing from the present invention. For example, numerical values in the above description of the exemplary embodiments may, of course, be set to different values as is advantageous. It is aimed, therefore, to cover in the appended claims all such changes and modifications filling within the true spirit and scope of the present invention.

DESCRIPTION OF REFERENCE NUMERALS

1, 2, 3, 4, 5, 6, 7, 8 LED
12 lighting control device of a vehicle lighting equipment
14, 16 switching regulator
18 controlling portion
20, 22 current setting portion
24, 26, 28, 30, 32, 34, 36, 38 current driving portion
40 NMOS transistor
42 control circuit
56 NPN transistor
58 operational amplifier
60 PNP transistor
62 operational amplifier
64 NMOS transistor

What is claimed is:

1. A lighting controlling device of vehicle lighting equipment, comprising:

switching regulators for supplying a current to a plurality of semiconductor light sources respectively;

a plurality of current driving means, comprising switching means connected to the semiconductor light sources for controlling ON/OFF of the semiconductor light sources, for current-driving the semiconductor light sources at a maximum current value or a current value smaller than the maximum current value in response to respective operating states of the switching means;

current setting means for setting a maximum current value applied in current-driving the current driving means or a maximum current value of currents fed from the switching regulators to the semiconductor light sources separately in plural stages in response to respective assignments; and a controlling portion for controlling the current driving means and the current setting means in response to a plurality of lighting modes based on communication information from an external device;

wherein the controlling portion assigns the maximum current value corresponding to each lighting mode to the current setting means for every lighting mode, and assigns ON/OFF periods of the switching means to the current driving means for every lighting mode.

2. A lighting controlling device of vehicle lighting equipment according to claim 1, wherein the plurality of current driving means are classified into plural groups such that the current driving means used commonly in the plurality of lighting modes in all are classified into same groups, wherein the current driving means in respective groups are connected electrically mutually, and wherein the controlling portion:

assigns the ON/OFF periods of the switching means to the current driving means, which are connected to the semiconductor light sources as turned-ON and dimmed objects, out of the current driving means in respective groups under same driving conditions for every group, and assigns an OFF drive to the current driving means that are connected to the semiconductor light sources as turned-OFF objects, based on elements different from elements that are used to assign the ON/OFF period.

3. A lighting controlling device of vehicle lighting equipment comprising:

switching regulators for supplying a current to a plurality of semiconductor light sources respectively;

a plurality of current driving portions for current-driving the semiconductor light sources;

the plurality of current driving portions comprising switching elements connected to the semiconductor light sources for controlling ON/OFF of the semiconductor light sources, wherein the plurality of current driving portions current-drive the semiconductor light sources at a maximum current value or a current value smaller than the maximum current value in response to respective operating states of the switching elements;

current setting portion for setting the maximum current value applied in current-driving the current driving portion or a maximum current value of currents fed from the switching regulators to the semiconductor light sources separately in plural stages in response to respective assignments; and a controlling portion for controlling the current driving portion and the current setting portion in response to a plurality of lighting modes based on communication information from an external device, wherein the controlling portion assigns the maximum current value corresponding to each lighting mode to the current setting portion for every lighting mode, and assigns ON/OFF periods of the switching elements to the current driving portion for every lighting mode.

4. A lighting controlling device of vehicle lighting equipment according to claim 3, wherein the plurality of current driving portions are classified into plural groups such that the current driving portions used commonly in the plurality of lighting modes in all are classified into same groups, wherein the current driving portions in respective groups are connected electrically mutually, and wherein the controlling portion:

assigns the ON/OFF periods of the switching portions to the current driving portions, which are connected to the semiconductor light sources as turned-ON and dimmed objects, out of the current driving portions in respective groups under same driving conditions for every group, and assigns an OFF drive to the current driving portions that are connected to the semiconductor light sources as turned-OFF objects, based on elements different from elements that are used to assign the ON/OFF period.

5. A method of controlling vehicle lighting equipment comprising a plurality of semiconductor light sources, the method comprising:

supplying a current to the plurality of semiconductor light sources respectively;

current-driving the semiconductor light sources at a maximum current value or a current value smaller than the maximum current value based on ON/OFF controls for the respective semiconductor light sources;

setting the maximum current value applied in current-driving or a maximum current value of currents fed to the semiconductor light sources separately in plural stages in response to assignment respectively;

controlling the current-driving and the setting of the maximum current in response to a plurality of lighting modes based on communication information from an external device, assigning the maximum current value corresponding to each lighting mode for every lighting mode; and assigning ON/OFF periods for the current-driving for every lighting mode.

6. The method of controlling vehicle lighting equipment according to claim 5, further comprising:

classifying common current-driving of the semiconductor light sources in the plurality of lighting modes into groups; and assigning the ON/OFF periods to the current-driving based on the respective groups under same driving conditions for every group, and assigning an OFF drive to the current-driving based on elements different from elements that are used to assign the ON/OFF period.

* * * * *